US009907991B2

(12) United States Patent
Leipheimer

(10) Patent No.: US 9,907,991 B2
(45) Date of Patent: Mar. 6, 2018

(54) FITNESS BAR CATCH MECHANISM

(71) Applicant: Specialty Fitness Systems, LLC, Franklin, PA (US)

(72) Inventor: Jerry K. Leipheimer, Sharpsville, PA (US)

(73) Assignee: Specialty Fitness Systems, LLC, Franklin, PA (US)

( * ) Notice: Subject to any disclaimer, the term of this patent is extended or adjusted under 35 U.S.C. 154(b) by 0 days.

(21) Appl. No.: 15/203,850

(22) Filed: Jul. 7, 2016

(65) Prior Publication Data

US 2017/0007877 A1 Jan. 12, 2017

Related U.S. Application Data

(60) Provisional application No. 62/189,828, filed on Jul. 8, 2015.

(51) Int. Cl.

| | |
|---|---|
| ***A63B 21/06*** | (2006.01) |
| ***A63B 21/062*** | (2006.01) |
| ***A63B 21/078*** | (2006.01) |
| ***A63B 21/00*** | (2006.01) |
| ***A63B 21/072*** | (2006.01) |

(52) U.S. Cl.

CPC ..... *A63B 21/0783* (2015.10); *A63B 21/0626* (2015.10); *A63B 21/078* (2013.01); *A63B 21/0724* (2013.01); *A63B 21/4029* (2015.10); *A63B 21/4035* (2015.10)

(58) Field of Classification Search

CPC . A63B 21/0783; A63B 21/08; A63B 21/0724; A63B 21/062–21/0632

See application file for complete search history.

(56) References Cited

U.S. PATENT DOCUMENTS

| | | | | |
|---|---|---|---|---|
| 2,504,922 | A * | 4/1950 | Dowell | A63B 25/00 482/76 |
| 4,729,561 | A * | 3/1988 | Desjardins | A63B 21/078 482/104 |
| 5,462,508 | A * | 10/1995 | Schiavone | A63B 21/055 482/122 |
| D444,827 | S | 7/2001 | Mobley | |
| 6,447,430 | B1 * | 9/2002 | Webb | A63B 21/154 482/93 |
| 7,070,546 | B1 * | 7/2006 | Grasso | A63B 21/072 482/103 |
| 7,094,185 | B2 | 8/2006 | Greenland | |

(Continued)

OTHER PUBLICATIONS

Super J-Cups (Pair) by OneFitWonder. Online Article, Nov. 26, 2014, Fringe Sport, https://www.frinngesport.com/products/onefitwonder-supercup-j-cups-pair.

(Continued)

*Primary Examiner* — Nyca T Nguyen
(74) *Attorney, Agent, or Firm* — The Webb Law Firm

(57) ABSTRACT

A fitness bar catch includes a first side plate, a central plate perpendicular and adjacent to the first side plate, a second side plate perpendicular and adjacent to the central plate and parallel to the first side plate, a stud extending perpendicular from the second side plate, a bar rest extending from the second side plate, and a safety mechanism extending from the first side plate. The safety mechanism may be engageable to prevent lateral movement of the fitness bar catch relative to a vertical support member.

20 Claims, 7 Drawing Sheets

(56) References Cited

U.S. PATENT DOCUMENTS

| | | | | |
|---|---|---|---|---|
| D562,670 | S | 2/2008 | Rogers et al. | |
| 7,338,416 | B2 | 3/2008 | Smith | |
| 7,699,756 | B2 * | 4/2010 | Piane, Jr. | A63B 1/00 248/222.52 |
| 7,753,830 | B1 * | 7/2010 | Marsh | A63B 21/078 482/104 |
| 8,172,731 | B1 | 5/2012 | Bredda | |
| 8,337,370 | B2 | 12/2012 | Rogers et al. | |
| 8,998,781 | B1 * | 4/2015 | Nelson | A63B 21/04 482/129 |
| 9,044,643 | B2 | 6/2015 | Staten et al. | |
| 2004/0162200 | A1 | 8/2004 | Brawner | |
| 2004/0242385 | A1 * | 12/2004 | Emick | A63B 21/0724 482/106 |
| 2007/0032357 | A1 * | 2/2007 | Piane, Jr. | A63B 1/00 482/142 |
| 2007/0099773 | A1 * | 5/2007 | Hummer, Jr. | A63B 21/078 482/104 |
| 2008/0004165 | A1 * | 1/2008 | Brawner | A63B 21/078 482/104 |
| 2012/0289384 | A1 | 11/2012 | Staten et al. | |
| 2013/0184128 | A1 * | 7/2013 | Towley, III | A63B 21/0628 482/102 |
| 2014/0200117 | A1 | 7/2014 | Grider | |
| 2015/0083681 | A1 * | 3/2015 | Childs | A63B 21/078 211/85.7 |

OTHER PUBLICATIONS

Spring Loaded Pull Pins. Online Article, Sep. 13, 2016, Alibaba.com, https://www.alibaba.com/product-detail/spring-loaded-pull-pins_60234957307.html.

Fat Bar J-hooks. Online Article, Matrix Fitness. Apr. 29, 2015 https://s3-us-west-2.amazonaws.com/sellsheets-outbound/prod/en-US/opt26-fat-bar-j-hooks-strength-45674-en-us-sellsheet.pdf.

Reverse J-hooks. Online Article, Matrix Fitness. Apr. 29, 2015 https://s3-us-west-2.amazonaws.com/sellsheets-outbound/prod/en-US/dopt1r-reverse-j-hooks-strength-45882-en-us-sellsheet.pdf.

* cited by examiner

FITNESS BAR CATCH MECHANISM

CROSS-REFERENCE TO RELATED APPLICATION

This application claims the benefit of U.S. Provisional Patent Application No. 62/189,828, filed Jul. 8, 2015, the disclosure of which is incorporated by reference in its entirety.

BACKGROUND OF THE INVENTION

Field of the Invention

This disclosure relates generally to exercise machines. More specifically, the disclosure relates to a fitness bar catch mechanism for safely retaining a fitness bar on a support frame of an exercise machine while allowing for easy adjustability of the fitness bar catch.

Description of Related Art

Many weightlifting exercises require a fitness bar to be positioned above the ground before the user can begin the exercise routine. Additionally, a user must have a place to rest the fitness bar upon completion of the exercise routine. The proper positioning of the fitness bar is typically achieved by placing the fitness bar on bar catches which are part of a support frame system in the exercise machine. While many configurations of the support frame system are known in the art, there is often a compromise between the ease of adjustability of the bar catches and how securely each bar catch attaches to the support frame.

U.S. Pat. No. 8,337,370 to Rogers et al. ("Rogers"), the disclosure of which is hereby incorporated in its entirety, discloses a fitness bar catch having studs which engage slots on opposite sides of a vertical support member. Rogers also discloses a trigger-actuated safety pin which extends from the bar catch through an aperture in the support member.

U.S. Pat. No. 7,338,416 to Smith ("Smith"), the disclosure of which is hereby incorporated in its entirety, discloses a fitness bar catch which slides along a vertical support member and has a tab which engages slots on a front face of the support member.

U.S. Pat. No. 444,827 to Mobley ("Mobley"), the disclosure of which is hereby incorporated in its entirety, discloses a fitness bar catch having a pair of vertically aligned studs which engage a corresponding pair of slots in a vertical support member.

U.S. Patent Application Publication No. 2014/0200117 to Grider ("Grider"), the disclosure of which is hereby incorporated in its entirety, discloses a fitness bar catch similar to Smith in that it slides coaxially along a vertical support member and cannot be moved from the side of the vertical support member.

U.S. Pat. No. 9,044,643 to Staten et al. ("Staten"), the disclosure of which is hereby incorporated in its entirety, discloses a fitness bar similar to Rogers in that it relies on opposing studs which engage corresponding slots in a vertical support member. Staten also discloses a safety latch which is integral to a central plate of the bar catch.

Conventional fitness bar catches either provide secure attachment to the support frame at the expense of adjustability, or are readily adjustable but prone to inadvertently detaching from the support frame. Such detachment could leave the user without a place to safely rest the fitness bar upon completion of an exercise routine. Therefore, there is a current need in the art for a fitness bar catch mechanism that provides secure attachment to a support frame and efficient adjustability.

SUMMARY OF THE INVENTION

Therefore, it is an object of the present disclosure to provide a fitness bar catch which allows the user to easily adjust the position of the bar catch on a support frame. It is also an object of the present disclosure to address deficiencies in the art which potentially put a user at risk of the bar catch inadvertently detaching from the support frame.

The present disclosure relates to a fitness bar catch including a first side plate, a central plate perpendicular and adjacent to the first side plate, a second side plate perpendicular and adjacent to the central plate and parallel to the first side plate, a stud extending perpendicular from the second side plate, a bar rest extending from the second side plate, and a safety mechanism extending from the first side plate. The safety mechanism may be engageable to prevent lateral movement of the fitness bar catch relative to a vertical support member.

The safety mechanism may be configured to move between a locking position and an unlocking position. The safety mechanism may include a spring-loaded pull pin. The first side plate, the central plate, and the second side plate may form a substantially U-shaped member which defines an inner cavity to receive the vertical support member. The bar rest may include a base forming a retaining portion to prevent the vertical support member from falling from the bar rest, and a resting portion retained within the base. At least one plate may be provided against an inner surface of the second side plate. The at least one plate may define an aperture through which the stud extends. The stud and the safety mechanism may extend towards one another into an inner cavity defined by the first side plate, the central plate, and the second side plate.

In one aspect, a weightlifting apparatus may include a support frame comprising at least two vertical support members and at least one fitness bar catch provided on each vertical support member. Each fitness bar catch may include a first side plate, a central plate perpendicular and adjacent to the first side plate, a second side plate perpendicular and adjacent to the central plate and parallel to the first side plate, a stud extending perpendicular from the second side plate, a bar rest extending from the second side plate, and a safety mechanism extending from the first side plate. The safety mechanism may be engageable with the respective vertical support member to prevent lateral movement of the fitness bar catches relative to the vertical support members.

Each vertical support member may define a plurality of slots along a longitudinal length of the vertical support member. Each slot may be configured to receive the stud of each respective fitness bar catch. Each slot may define a vertical portion that extends parallel to the longitudinal axis of the vertical support member, and a horizontal portion that extends substantially perpendicular to the longitudinal axis of the vertical support member. The safety mechanism may be configured to move between a locking position and an unlocking position. The safety mechanism may include a spring-loaded pull pin. The first side plate, the central plate, and the second side plate may form a substantially U-shaped member which defines an inner cavity to receive the vertical support member. The bar rest may include a base forming a retaining portion to prevent the vertical support member from falling from the bar rest, and a resting portion retained within the base. At least one plate may be provided against an inner surface of the second side plate. The at least one plate may define an aperture through which the stud extends. The stud and the safety mechanism may extend towards one another into an inner cavity defined by the first side plate, the central plate, and the second side plate.

In another aspect, a method for setting the height of a fitness bar support may include disengaging a safety mechanism of a fitness bar catch; inserting a stud of the fitness bar catch into a slot of a vertical support member at a desired height; and engaging the safety mechanism on a side surface of the vertical support member. The safety mechanism may constrain the fitness bar catch relative to the vertical support member. The method may further include, when the stud of the fitness bar catch is inserted into the slot of the vertical support member, directing the stud along a horizontal portion of the slot and vertically within a vertical portion of the slot.

Further aspects of the disclosure will now be described in the following numbered clauses:

Clause 1: A fitness bar catch comprising: a first side plate; a central plate perpendicular and adjacent to the first side plate; a second side plate perpendicular and adjacent to the central plate and parallel to the first side plate; a stud extending perpendicular from the second side plate; a bar rest extending from the second side plate; and a safety mechanism extending from the first side plate, the safety mechanism engageable to prevent lateral movement of the fitness bar catch relative to a vertical support member.

Clause 2: The fitness bar catch of clause 1, wherein the safety mechanism is configured to move between a locking position and an unlocking position.

Clause 3: The fitness bar catch of clause 1 or 2, wherein the safety mechanism comprises a spring-loaded pull pin.

Clause 4: The fitness bar catch of any of clauses 1-3, wherein the first side plate, the central plate, and the second side plate form a substantially U-shaped member which defines an inner cavity to receive the vertical support member.

Clause 5: The fitness bar catch of any of clauses 1-4, wherein the bar rest comprises: a base forming a retaining portion to prevent the vertical support member from falling from the bar rest, and a resting portion retained within the base.

Clause 6: The fitness bar catch of any of clauses 1-5, further comprising at least one plate provided against an inner surface of the second side plate.

Clause 7: The fitness bar catch of clause 6, wherein the at least one plate defines an aperture through which the stud extends.

Clause 8: The fitness bar catch of any of clauses 1-7, wherein the stud and the safety mechanism extend towards one another into an inner cavity defined by the first side plate, the central plate, and the second side plate.

Clause 9: A weightlifting apparatus, comprising: a support frame comprising at least two vertical support members; and at least one fitness bar catch provided on each vertical support member, each fitness bar catch comprising: a first side plate; a central plate perpendicular and adjacent to the first side plate; a second side plate perpendicular and adjacent to the central plate and parallel to the first side plate; a stud extending perpendicular from the second side plate; a bar rest extending from the second side plate; and a safety mechanism extending from the first side plate, the safety mechanism engageable with the respective vertical support member to prevent lateral movement of the fitness bar catches relative to the vertical support members.

Clause 10: The weightlifting apparatus of clause 9, wherein each vertical support member defines a plurality of slots along a longitudinal length of the vertical support member, each slot being configured to receive the stud of each respective fitness bar catch.

Clause 11: The weightlifting apparatus of clause 9 or 10, wherein each slot defines a vertical portion that extends parallel to the longitudinal axis of the vertical support member and a horizontal portion that extends substantially perpendicular to the longitudinal axis of the vertical support member.

Clause 12: The weightlifting apparatus of any of clauses 9-11, wherein the safety mechanism is configured to move between a locking position and an unlocking position.

Clause 13: The weightlifting apparatus of any of clauses 9-12, wherein the safety mechanism comprises a spring-loaded pull pin.

Clause 14: The weightlifting apparatus of any of clauses 9-13, wherein the first side plate, the central plate, and the second side plate form a substantially U-shaped member which defines an inner cavity to receive the vertical support member.

Clause 15: The weightlifting apparatus of any of clauses 9-14, wherein the bar rest comprises: a base forming a retaining portion to prevent the vertical support member from falling from the bar rest, and a resting portion retained within the base.

Clause 16: The weightlifting apparatus of any of clause 9-15, further comprising at least one plate provided against an inner surface of the second side plate.

Clause 17: The weightlifting apparatus of clause 16, wherein the at least one plate defines an aperture through which the stud extends.

Clause 18: The weightlifting apparatus of any of clauses 9-17, wherein the stud and the safety mechanism extend towards one another into an inner cavity defined by the first side plate, the central plate, and the second side plate.

Clause 19: A method for setting the height of a fitness bar support, comprising: disengaging a safety mechanism of a fitness bar catch; inserting a stud of the fitness bar catch into a slot of a vertical support member at a desired height; and engaging the safety mechanism on a side surface of the vertical support member, whereby the safety mechanism constrains the fitness bar catch relative to the vertical support member.

Clause 20: The method of clause 19, further comprising, when the stud of the fitness bar catch is inserted into the slot of the vertical support member, directing the stud along a horizontal portion of the slot and vertically within a vertical portion of the slot.

These and other features and characteristics of the fitness bar catch mechanism, as well as the methods of use of the fitness bar catch mechanism, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure. As used in the specification and the claims, the singular form of "a", "an", and "the" include plural referents unless the context clearly dictates otherwise.

DESCRIPTION OF THE DISCLOSURE

Figure 1:
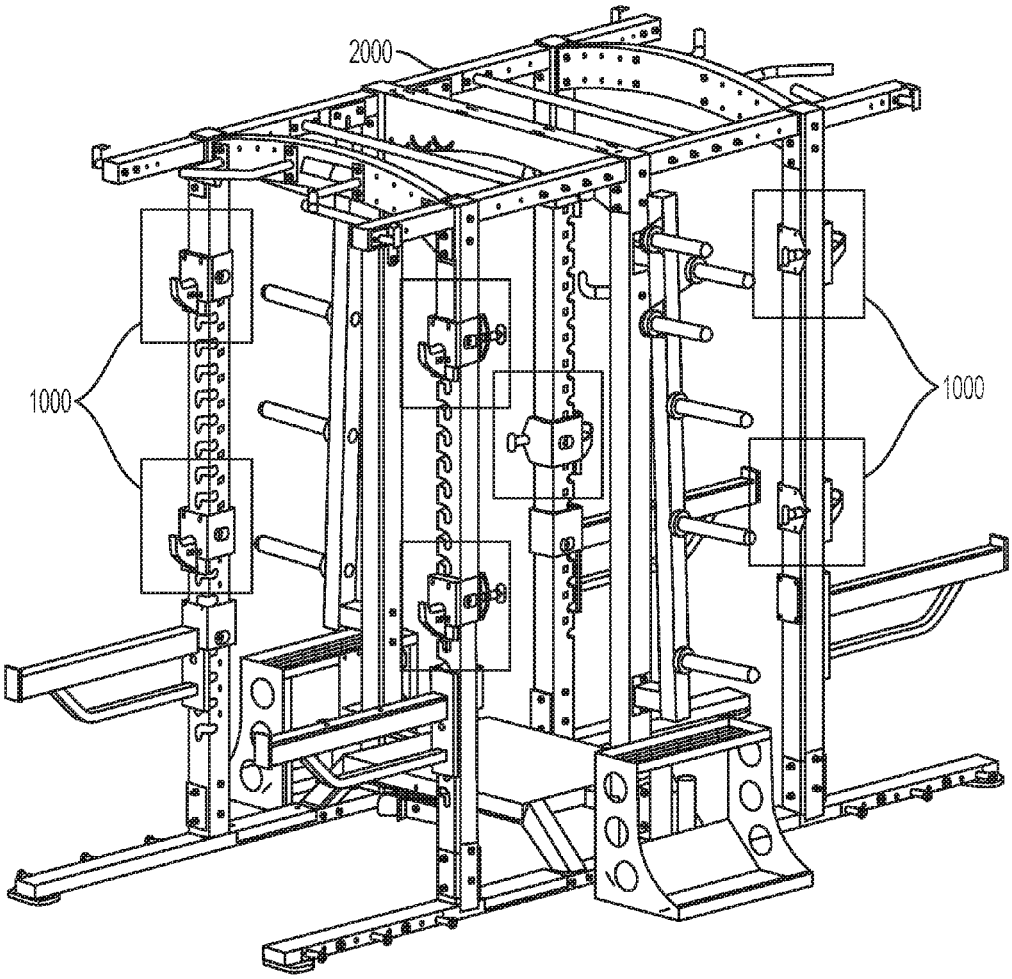
FIG. 1 is a perspective view of a weightlifting system containing a plurality of fitness bar catch mechanisms according to the present disclosure attached to vertical support members of a support frame.

For the purposes of the description hereinafter, the terms "upper", "lower", "right", "left", "vertical", "horizontal", "top", "bottom", "side", "front", "back", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

With reference to FIG. 1, a weightlifting support frame 2000 which includes several fitness bar catch mechanisms 1000 (hereinafter referred to as "fitness bar catch") attached thereto is shown. It should be understood that although one configuration of a support frame is illustrated in the disclosed embodiment, other configurations of the support frame will be equally suitable for use with the present disclosure. The fitness bar catch 1000 of the present disclosure is configured for use with any weightlifting system that includes support frames. The fitness bar catches 1000 may be adjustably positioned on the support frame 2000 to permit a user to adjust the height of each fitness bar catch 1000 depending on the height of the user or the specific exercise routine the user is performing. As shown in one aspect in FIG. 1, a fitness bar catch 1000 may be positioned at an upper position on the support frame 2000 or may be positioned on a lower position of the support frame 2000.

Figure 2:
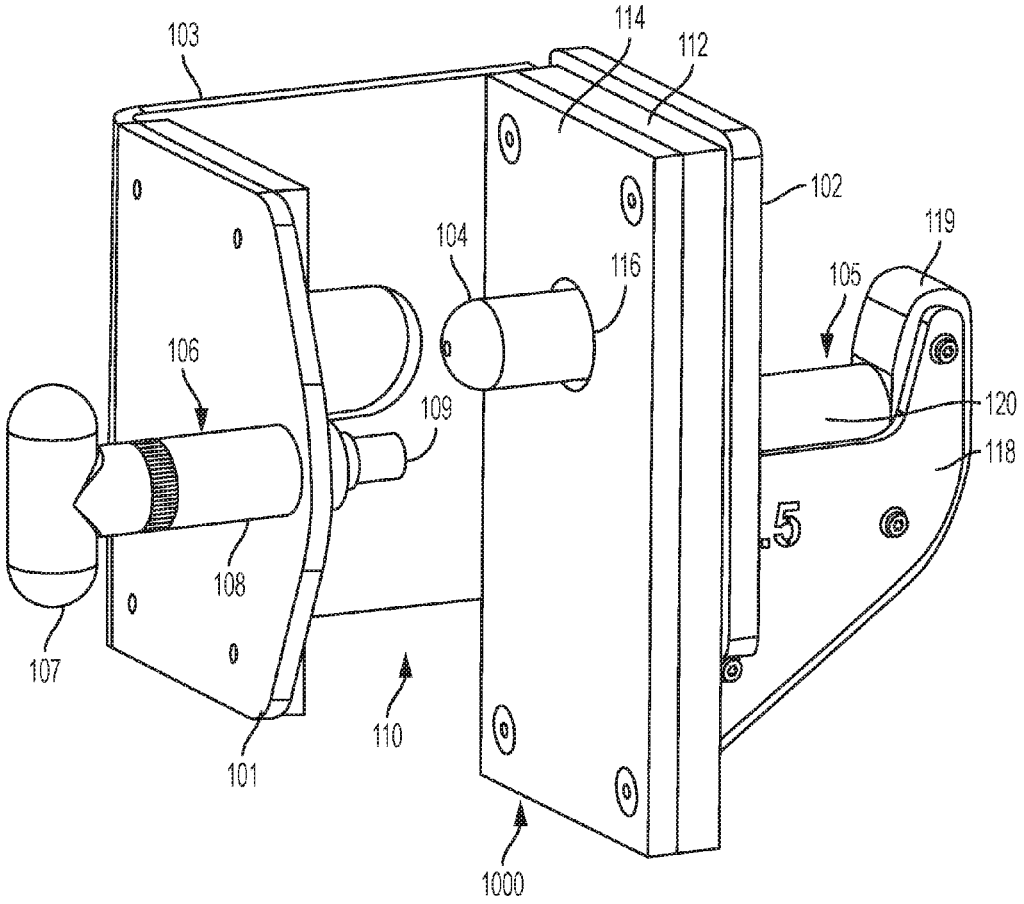
FIG. 2 is a side perspective view of a fitness bar catch mechanism according to the present disclosure.

With reference to FIG. 2, a fitness bar catch 1000 according to one aspect of the disclosure includes a first side plate 101, a second side plate 102 provided opposite the first side plate 101 and extending substantially parallel to the first side plate 101, and a central plate 103 transverse of, or perpendicular to, and adjacent the first and second side plates 101 and 102. In one aspect, the first side plate 101, the second side plate 102, and the central plate 103 may form a generally U-shaped enclosure that defines an inner cavity 110 to receive a vertical support member 201 (shown in FIG. 3) of a support frame 2000. The central plate 103 may extend between the first side plate 101 and the second side plate 102. The first side plate 101, the second side plate 102, and the central plate 103 may be connected using fasteners, adhesive, or welding, among other connection methods. It is also contemplated that the first side plate 101, the second side plate 102, and the central plate 103 may be integrally formed together into a monolithic structure. A stud 104 may extend into the inner cavity 110 from an inner surface of the second side plate 102 towards the first side plate 101. Two additional plates 112, 114 may be positioned against the inner surface of the second side plate 102. The plates 112, 114 may define an aperture 116 through which the stud 104 may extend through into the inner cavity 110. A bar rest 105, which is configured to support and retain the weight of a fitness bar, extends from an outer surface of the second side plate 102, opposite the inner surface of the second side plate 102 from which the stud 104 extends. The bar rest 105 may include a base 118 that is connected to the second side plate 102 and forms a retaining portion 119 that prevents a fitness bar from moving off of the bar rest 105. The bar rest 105 may also include a resting portion 120 that is received within the base 118 and is configured to support the fitness bar.

In the aspect shown in FIG. 2, a spring-loaded pull pin 106 may be mounted to the first side plate 101 and may include a handle 107, a pin housing 108 which contains a spring (not shown), and a safety pin 109. The safety pin 109 extends into the inner cavity 110 towards the second side plate 102. The handle 107 may be manually pulled by a user away from the first side plate 101 to retract the safety pin 109 into the pin housing 108, thereby allowing the fitness bar catch 1000 to be positioned at a desired location on the vertical support member 201 of the support frame 2000, as described in detail below. The spring within the pin housing 108 biases the safety pin 109 out of the pin housing 108 so that once the user releases the handle 107, the safety pin 109 is pushed out of the pin housing 108 by the spring.

Figure 3:
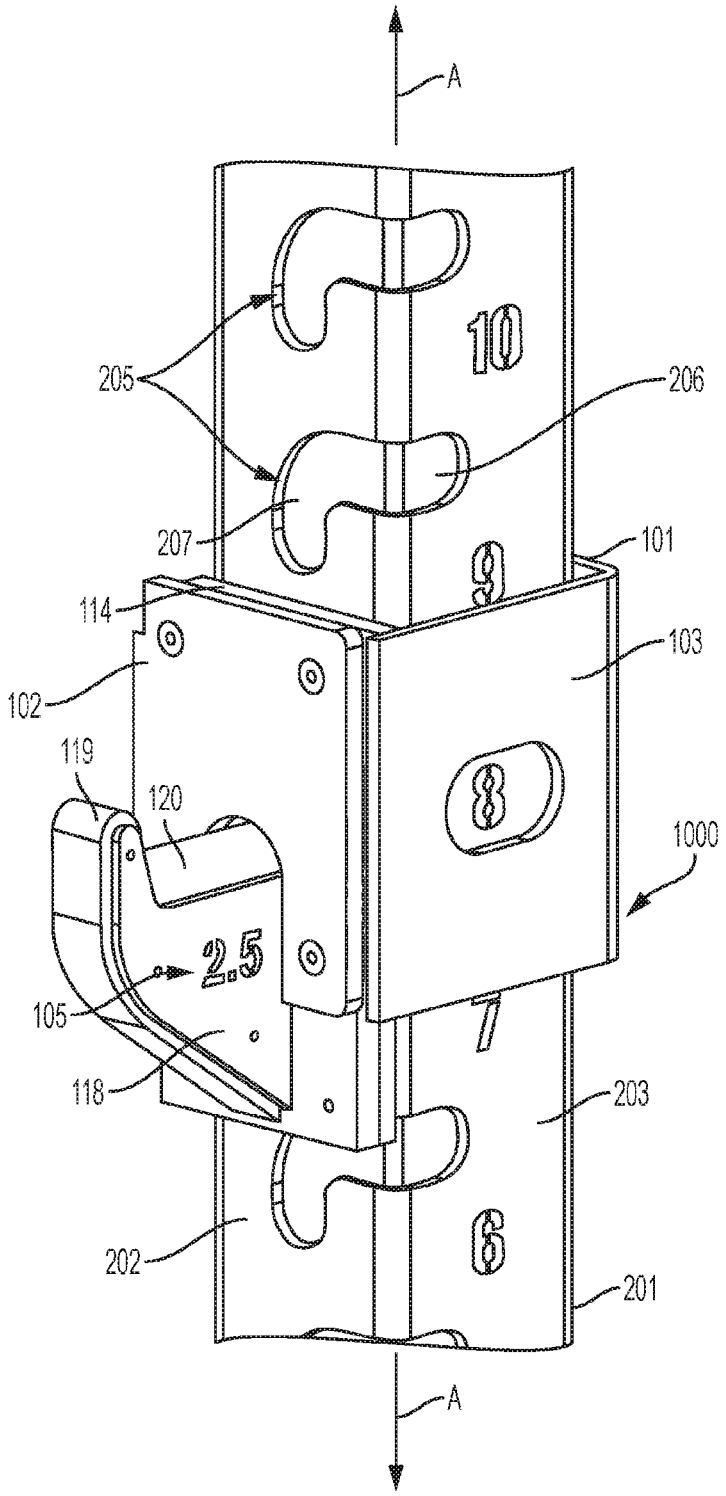
FIG. 3 is a front perspective view of the fitness bar catch mechanism of FIG. 2 positioned on a vertical support member.

With reference to FIG. 3, the fitness bar catch 1000 is shown in an attached position on a vertical support member 201 of the support frame 2000. The vertical support member 201 may extend along a longitudinal axis A, which is generally in a vertical direction relative to a ground surface. The vertical support member 201 may be generally rectilinear and may have a plurality of slots 205 which receive the stud 104 of the fitness bar catch 1000 to hold the fitness bar catch 1000 on the vertical support member 201 at various heights relative to the ground surface. The slots 205 may be defined at different vertical positions on the vertical support member 201 to permit the user to attach the fitness bar catch 1000 at different heights on the vertical support member 201. When attached to the vertical support member 201, the inner cavity 110 of the fitness bar catch 1000 may receive the vertical support member 201, as described in greater detail below.

Each slot 205 may have a substantially J-shape or L-shape and may define a horizontal portion 206 and a vertical portion 207. The horizontal portion 206 of each slot 205 may be substantially perpendicular to the longitudinal axis A and may extend from the first side face 203 of the vertical support member 201 to an adjacent front face 202 of the vertical support member 201. Thus, each slot 205 spans the intersection of the first side face 203 and the adjacent front face 202. The vertical portion 207 of each slot 205 may extend vertically along the front face 202 of the vertical support member 201 in a direction substantially parallel to the longitudinal axis A. The vertical portion 207 may extend downwardly from the horizontal portion 206. In one aspect, the intersection of the horizontal portion 206 and the vertical portion 207 of each slot 205 has a substantially large corner radii.

Figure 4:
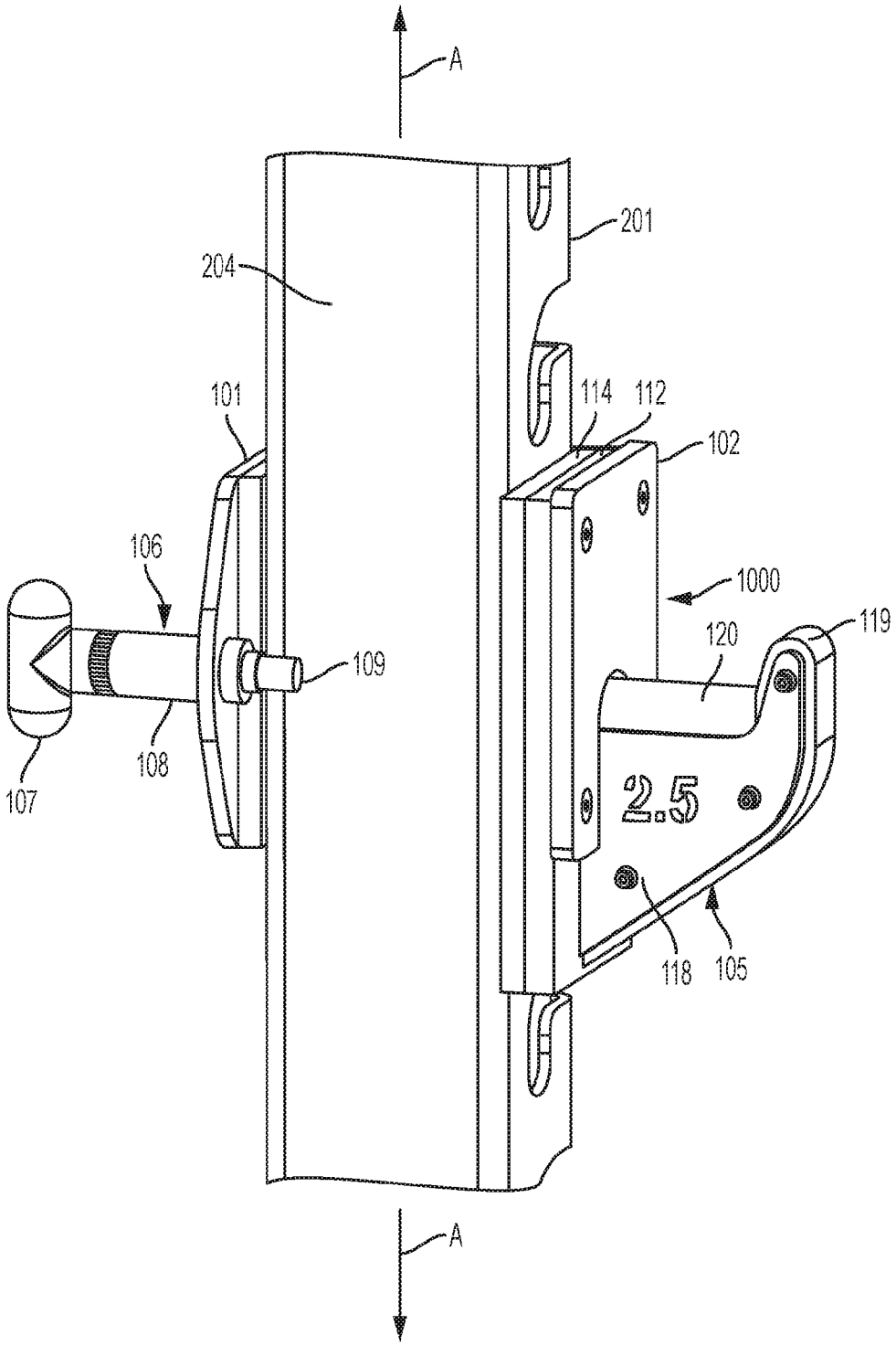
FIG. 4 is a side perspective view of the fitness bar catch mechanism of FIG. 2 positioned on a vertical support member.

With reference to FIG. 4, a safety mechanism provided with the fitness bar catch 1000 is shown locking the fitness bar catch 1000 to the vertical support member 201. The safety mechanism may be any device or mechanism that retains the fitness bar catch 1000 against an outer face of the vertical support member 201 until the safety mechanism is manually disengaged by a user. For example, the safety mechanism may be a latch, rotatable cam, or similar feature that locks the fitness bar catch 1000 on the vertical support member 201. In one aspect, the safety mechanism may be the spring-loaded pull pin 106 provided on the fitness bar catch 1000. In this aspect, the safety pin 109 abuts a second side face 204 of the vertical support member 201, the second side face 204 provided opposite the central plate 103 of the fitness bar catch 1000, to prevent the fitness bar catch 1000 from shifting or being pulled perpendicular relative to the longitudinal axis A. The safety pin 109 may extend along the second side face 204, but does not insert into or extend through any face of the vertical support member 201. By positioning the safety pin 109 against the second side face 204 of the vertical support member 201, the fitness bar catch 1000 is held tightly against the vertical support member 201 so that the fitness bar catch 1000 cannot rotate around the longitudinal axis A of the vertical support member or cannot be pulled or pushed away from the vertical support member 201.

Figure 5:
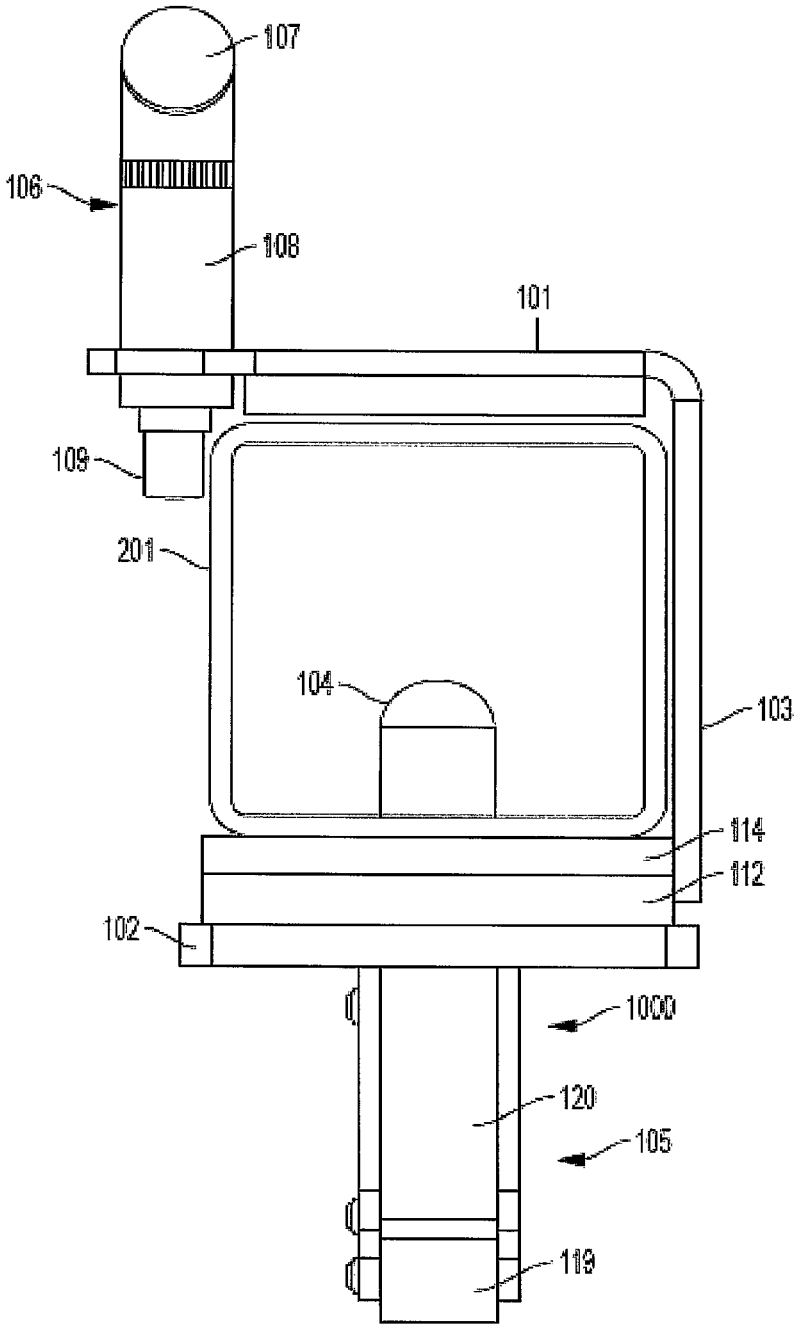
FIG. 5 is a top view of the fitness bar catch mechanism of FIG. 2 positioned on a vertical support member with a safety mechanism shown in a locked position.

FIG. 5 shows a top view of the pull pin 106 in a locking position of the fitness bar catch 1000 on the vertical support member 201. The stud 104 protrudes through one of the slots 205 of the vertical support member 201 and rests in the base or bottom portion of the vertical portion 207 of the slot 205. With the fitness bar catch 1000 being generally U-shaped and the vertical support member 201 being generally rectilinear, lateral movement of the fitness bar catch 1000 relative to the vertical support member 201 is substantially prohibited. The vertical support member 201 is laterally constrained by the first side plate 101, the second side plate 102, the central plate 103, and the safety pin 109.

Figure 6:
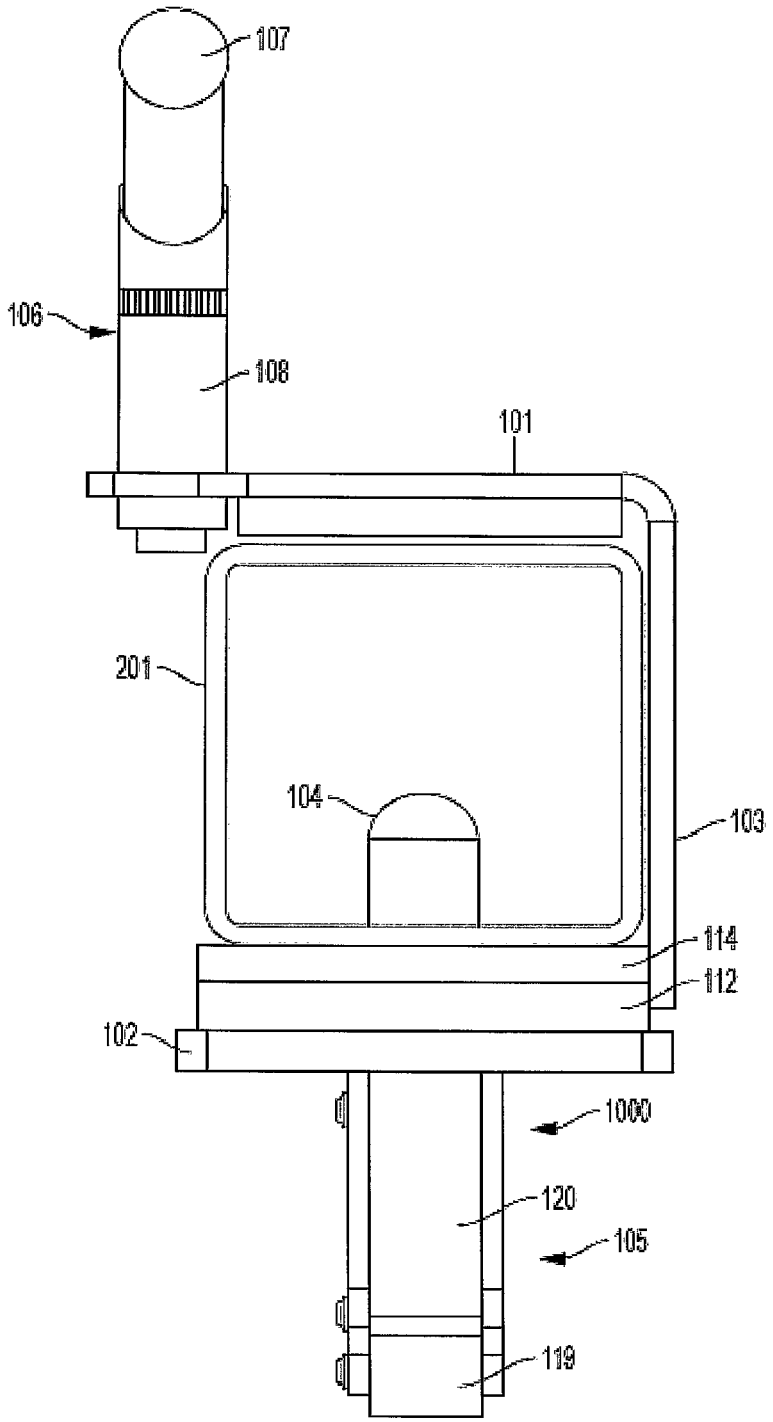
FIG. 6 is a top view of the fitness bar catch mechanism of FIG. 2 positioned on a vertical support member with a safety mechanism shown in an unlocked position.
Figure 7:
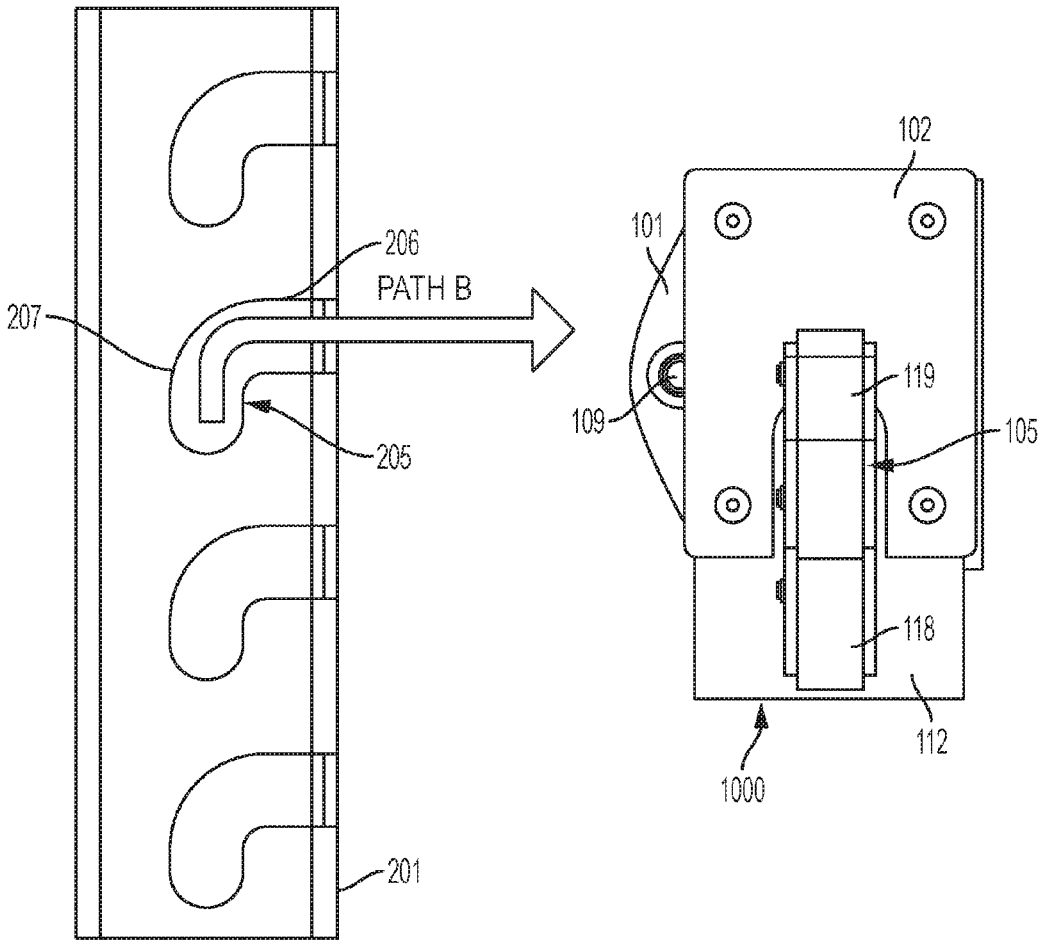
FIG. 7 is a front view of the fitness bar catch mechanism of FIG. 2 detached from a vertical support member.

With reference to FIG. 6, path B illustrates the path along which the fitness bar catch 1000 must be guided in order to detach the fitness bar catch 1000 from the vertical support member 201. The stud 104 is directed upwards from the bottom portion of the vertical portion 207 and along the horizontal portion 206 of the slot 205 in the vertical support member 201 to allow the user to pull the fitness bar catch 1000 away from the vertical support member 201.

The use and operation of the fitness bar catch 1000 is now described with reference to FIGS. 3-6. To attach the fitness bar catch 1000 to the vertical support member 201, a user first must pull the handle 107 of the spring-loaded pull pin 106 outwardly away from the first side plate 101, thereby retracting the safety pin 109 into the pin housing 108 and away from the vertical support member 201. The user then slides the fitness bar catch 1000 along the longitudinal axis A of the vertical support member 201 until the fitness bar catch 1000 is positioned adjacent the desired slot 205. The fitness bar catch 1000 is positioned adjacent the slot 205 such that the stud 104 is adjacent the slot 205 at a desired height. As the fitness bar catch 1000 is slid along the vertical support member 201, the fitness bar catch 1000 is offset from the vertical support member 201 so the stud 104 does not engage or get caught within a slot 205. The user then guides the fitness bar catch 1000 inwardly towards the vertical support member 201 such that the stud 104 of the fitness bar catch 1000 is directed into the horizontal portion 206 of the desired slot 205. The user then guides the fitness bar catch 1000 to the corner portion of the slot 205 and then downwardly through the vertical portion 207 of the slot 205. The user guides the fitness bar catch 1000 to the bottom of the vertical portion 207 such that the stud 104 rests on the bottom surface defined by the vertical portion 207 of the slot 205. Lastly, the user will release the handle 107, thereby permitting the safety pin 109 to extend inwardly towards the vertical support member 201 to lock the fitness bar catch 1000 to the vertical support member 201. The safety pin 109 may abut the second side face 204 of the vertical support member 201.

The safety mechanism requires manual disengagement by a user to remove the fitness bar catch 1000 from the vertical support member 201, ensuring the fitness bar catch 1000 cannot inadvertently detach from the vertical support member 201, resulting in the fitness bar dropping onto the ground surface or the user. To remove the fitness bar catch 1000 from the vertical support member 201, the user first pulls the handle 107 outwardly away from the first side plate 101, thereby retracting the safety pin 109 within the pin housing 108 and away from the vertical support member 201. The user then guides the fitness bar catch 1000 upwards such that the stud 104 of the fitness bar catch 1000 moves upwards through the vertical portion 207 of the slot 205. The user then directs the fitness bar catch 1000 outwards in a direction perpendicular to the longitudinal axis A of the vertical support member 201 so the stud 104 is moved along the horizontal portion 206 of the slot 205. As the stud 104 is directed along the horizontal portion 206, the stud 104 will eventually be directed out of the open end of the horizontal portion 206 and out of the slot 205 away from the vertical support member 201. With the fitness bar catch 1000 clear of the slot 205 defined in the vertical support member 201, the user can release the handle 107 to allow the safety pin 109 to extend towards the second side plate 102 of the fitness bar catch 1000. The user is then able to move the fitness bar catch 1000 along the longitudinal axis A of the vertical support member 201 to a different slot 205.

While various aspects of the fitness bar catch 1000 were provided in the foregoing description, those skilled in the art may make modifications and alterations to these aspects without departing from the scope and spirit of the disclosure. For example, it is to be understood that this disclosure contemplates that, to the extent possible, one or more features of any aspect can be combined with one or more features of any other aspect. Accordingly, the foregoing description is intended to be illustrative rather than restrictive. The invention described hereinabove is defined by the appended claims and all changes to the disclosure that fall within the meaning and the range of equivalency of the claims are to be embraced within their scope.

The invention claimed is:

1. A fitness bar catch comprising:

a first side plate;

a central plate perpendicular and adjacent to the first side plate;

a second side plate perpendicular and adjacent to the central plate and parallel to the first side plate;

a stud extending perpendicular from the second side plate insertable into a slot of a vertical support member;

a bar rest extending from the second side plate; and a safety mechanism comprising a pull pin extending from the first side plate, the safety mechanism engageable with a side surface of the vertical support member positioned opposite the central plate to prevent lateral movement of the fitness bar catch relative to the vertical support member.

2. The fitness bar catch of claim 1, wherein the safety mechanism is configured to move between a locking position and an unlocking position.

3. The fitness bar catch of claim 1, wherein the pull pin comprises a spring-loaded pull pin.

4. The fitness bar catch of claim 1, wherein the first side plate, the central plate, and the second side plate form a substantially U-shaped member which defines an inner cavity to receive the vertical support member.

5. The fitness bar catch of claim 1, wherein the bar rest comprises:

a base forming a retaining portion to prevent a fitness bar from falling from the bar rest, and a resting portion retained within the base.

6. The fitness bar catch of claim 1, further comprising at least one plate provided against an inner surface of the second side plate.

7. The fitness bar catch of claim 6, wherein the at least one plate defines an aperture through which the stud extends.

8. The fitness bar catch of claim 1, wherein the stud and the safety mechanism extend towards one another into an inner cavity defined by the first side plate, the central plate, and the second side plate.

9. A weightlifting apparatus, comprising:

a support frame comprising at least two vertical support members; and at least one fitness bar catch provided on each vertical support member, each fitness bar catch comprising:

a first side plate;

a central plate perpendicular and adjacent to the first side plate;

a second side plate perpendicular and adjacent to the central plate and parallel to the first side plate;

a stud extending perpendicular from the second side plate insertable into a slot of the respective vertical support member;

a bar rest extending from the second side plate; and a safety mechanism comprising a pull pin extending from the first side plate, the safety mechanism engageable with a side surface of the respective vertical support member positioned opposite the central plate to prevent lateral movement of the fitness bar catches relative to the vertical support members.

10. The weightlifting apparatus of claim 9, wherein each vertical support member defines a plurality of slots along a longitudinal length of the vertical support member, each slot being configured to receive the stud of each respective fitness bar catch.

11. The weightlifting apparatus of claim 10, wherein each slot defines a vertical portion that extends parallel to the longitudinal axis of the vertical support member and a horizontal portion that extends substantially perpendicular to the longitudinal axis of the vertical support member.

12. The weightlifting apparatus of claim 9, wherein the safety mechanism is configured to move between a locking position and an unlocking position.

13. The weightlifting apparatus of claim 9, wherein the pull pin comprises a spring-loaded pull pin.

14. The weightlifting apparatus of claim 9, wherein the first side plate, the central plate, and the second side plate form a substantially U-shaped member which defines an inner cavity to receive the vertical support member.

15. The weightlifting apparatus of claim 9, wherein the bar rest comprises:

a base forming a retaining portion to prevent a fitness bar from falling from the bar rest, and a resting portion retained within the base.

16. The weightlifting apparatus of claim 9, further comprising at least one plate provided against an inner surface of the second side plate.

17. The weightlifting apparatus of claim 16, wherein the at least one plate defines an aperture through which the stud extends.

18. The weightlifting apparatus of claim 9, wherein the stud and the safety mechanism extend towards one another into an inner cavity defined by the first side plate, the central plate, and the second side plate.

19. A method for setting the height of a fitness bar support, comprising:

a. disengaging a safety mechanism comprising a pull pin of a fitness bar catch, the fitness bar catch comprising a first side plate, a central plate perpendicular and adjacent to the first side plate, and a second side plate perpendicular and adjacent to the central plate and parallel to the first side plate, the safety mechanism located on the first side plate;

b. inserting a stud located on the second side plate of the fitness bar catch into a slot of a vertical support member at a desired height; and c. engaging the safety mechanism against a side surface of the vertical support member opposite the central plate of the fitness bar catch, whereby the safety mechanism constrains the fitness bar catch relative to the vertical support member.

20. The method of claim 19, further comprising, when the stud of the fitness bar catch is inserted into the slot of the vertical support member, directing the stud along a horizontal portion of the slot and vertically within a vertical portion of the slot.

* * * * *